US006705386B2

(12) United States Patent
Demuth et al.

(10) Patent No.: US 6,705,386 B2
(45) Date of Patent: Mar. 16, 2004

(54) SERPENTINE HEAT EXCHANGER

(75) Inventors: Walter Demuth, Gerlingen (DE); Martin Kotsch, Ludwigsburg (DE); Hans-Joachim Krauss, Stuttgart (DE); Hagan Mittelstrass, Bondorf (DE); Harald Raiser, Balingen (DE); Michael Sickelmann, Stuttgart (DE); Karl-Heinz Staffa, Stuttgart (DE); Christoph Walter, Stuttgart (DE)

(73) Assignee: Behr GmbH & Co. Stuttgart (DE)

( * ) Notice: Subject to any disclaimer, the term of this patent is extended or adjusted under 35 U.S.C. 154(b) by 59 days.

(21) Appl. No.: 09/971,122

(22) Filed: Oct. 5, 2001

(65) Prior Publication Data

US 2002/0062953 A1 May 30, 2002

(30) Foreign Application Priority Data

Oct. 5, 2000 (DE) ..... 100 49 256

(51) Int. Cl.[7] ..... B60H 1/00
(52) U.S. Cl. ..... 165/42; 165/150
(58) Field of Search ..... 165/42, 144, 150, 165/41

(56) References Cited

U.S. PATENT DOCUMENTS

| | | | | |
|---|---|---|---|---|
| 3,416,600 A | | 12/1968 | Fink | 165/175 |
| 5,036,909 A | * | 8/1991 | Whitehead et al. | 165/150 X |

FOREIGN PATENT DOCUMENTS

| | | |
|---|---|---|
| DE | 1 786 826 | 4/1959 |
| DE | 196 41 029 | 4/1998 |
| DE | 197 19 261 | 11/1998 |
| DE | 197 29 497 | 1/1999 |
| DE | 198 44 930 | 9/1999 |
| EP | 0 334 683 | 9/1989 |

OTHER PUBLICATIONS

Patent Abstracts of Japan, Patent 07167532 published Jul. 4, 1995, "Mounting Apparatus for Expansion Valve Of Evaporation", by Inoue et al.
Patent Abstracts of Japan, Patent 08061808 published Mar. 8, 1996, "Air Conditioner For Vehicle", by Saijo et al.
Patent Abstracts of Japan, Patent 08219586 published Aug. 30, 1996, "Evaporator", by Yasutake.
Patent Abstracts of Japan, Patent 00028226 published Jan. 28, 2000, "Heat Exchanger for Carbonic Acid Refrigerating Cycle", by Koyama et al.

* cited by examiner

*Primary Examiner*—Ljiljana Ciric
(74) *Attorney, Agent, or Firm*—Foley & Lardner

(57) ABSTRACT

The invention relates to a serpentine heat exchanger having a first serpentine tube block (12*a*) comprising one or more adjacent first serpentine tube sections with parallel through-flow and a second serpentine tube block (12*b*) disposed behind the first and comprising one or more adjacent second serpentine tube sections with parallel through-flow. According to the invention, at least one of the second serpentine tube sections is connected in series for flow purposes via a diversion section (10, 11) to a first serpentine tube section lying adjacent thereto.

16 Claims, 5 Drawing Sheets

SERPENTINE HEAT EXCHANGER

BACKGROUND OF THE INVENTION

1. Field of the Invention

There has been provided a serpentine heat exchanger having a first serpentine tube block (12*a*) comprising one or more adjacent first serpentine tube sections with parallel through-flow and a second serpentine tube block (12*b*) disposed behind the first and comprising one or more adjacent second serpentine tube sections with parallel through-flow. At least one of the second serpentine tube sections is connected in series for flow purposes via a diversion section (10, 11) to a first serpentine tube section lying adjacent thereto.

2. Description of Related Art

Serpentine heat exchangers are disclosed in laid-open application DE 197 29 497 A1. These heat exchangers contain a plurality of tube blocks arranged one behind the other in a depth direction. Each tube block consists of a plurality of serpentine flat tube runs adjacent in a vertical direction of the block. All of the flat tube runs of all tube blocks open into appropriate collection chambers in a manner such that an air-conditioning system refrigerant can flow through them in parallel. In order to achieve a more uniform heat distribution within each tube block, provision can be made for an inlet tube side of each flat tube run to border an outlet side of a neighboring flat tube run.

DE 172 29 497 A1 also discloses a type of heat exchanger that contains one inlet-side tube block and one outlet-side tube block. The inlet-side tube block and the outlet side tube block are disposed one behind the other in the depth direction of the block and are formed, integrally, by respective halves of U-shaped flat tubes. The two flat tube halves are in fluid connection via the U-bend region which consequently forms a corresponding fluid diversion region. The two tube blocks each consist of adjacent, linear flat tube sections and are connected in series for flow purposes via the fluid deflection region. In this arrangement, the two flat tube halves are twisted relative to the U-bend region in a manner such that they lie perpendicularly to the vertical direction of the block, while the U-bend region lies parallel or at an acute angle to the vertical direction of the block. Instead of the U-shaped flat tubes, two linear flat tubes may be provided instead with a diversion channel replacing the U-bend region. The flat tubes open on the appropriate side of the block into the diversion channel. On the inlet and outlet sides, the flat tubes with parallel through-flow open into a connecting tube. The connecting tube is subdivided by means of a transverse partition into two separate collection chambers lying one behind the other in the depth direction of the block.

A flat tube evaporator for a motor vehicle air-conditioning system, similar to the above-mentioned heat exchanger type, is disclosed in laid-open application DE 197 19 261 A1. The evaporator described therein contains a tube block of linear, multichannel flat tubes. On one side of the block, two separate, adjacent collection chambers are provided, into which each flat tube opens with one part of its plurality of fluid channels. On the opposite side of the block, individual diversion channels for each flat tube or a common channel for all flat tubes are provided, in order to divert the flow coming from the inlet-side flat tube channels into the outlet-side flat tube channels.

SUMMARY OF THE INVENTION

Therefore, one object of the invention is to provide a serpentine heat exchanger, of the general type referred to above, which can produce a comparatively homogeneous distribution of heat, and therefore of temperature, and which is relatively simple to produce.

In accomplishing the objects of the invention, there has been provided according to one aspect of the invention a heat exchanger comprising a first serpentine tube block comprising at least one serpentine tube section; a second serpentine tube block comprising at least one serpentine tube section; and a diversion section; wherein the second serpentine tube block is arranged behind the first serpentine tube block and wherein at least one serpentine tube section of said second serpentine tube block is in serial fluid communication with at least one serpentine tube section of said first serpentine tube block via the diversion section.

In accordance with an additional aspect of the invention, there is provided a heat exchanger comprising a front tube block; a rear tube block arranged in serial fluid communication with the front tube block; a collector tube; a partition plate arranged to divide the collector tube into a front collection chamber and a rear collection chamber; a front flat tube channel in fluid communication with the front collection chamber; a rear flat tube channel in fluid communication with the rear chamber and arranged to allow for parallel flow along with the front flat tube channel; front serpentine flat tubes in fluid communication with the front flat tube channel; rear serpentine flat tubes in fluid communication with the rear flat tube channel; a front diversion tube piece in fluid communication with the front serpentine flat tubes; a rear diversion tube piece in fluid communication with the rear serpentine flat tubes; an outlet side front tube block in fluid communication with the front diversion tube piece; an outlet side rear tube block in fluid communication with the rear diversion tube piece such that a medium may flow in an opposite direction to a medium flowing through the outlet side front tube block; a first outlet side collection chamber in fluid communication with the outlet side front tube block; a second outlet side collection chamber in fluid communication with the outlet side rear tube block; and a collector pipe in fluid communication with the first and second outlet side collection chambers.

Further objects, features and advantages of the present invention will become apparent from the detailed description of preferred embodiments that follows when considered together with the accompanying drawings.

BRIEF DESCRIPTION OF THE DRAWINGS

The invention is explained in detail below with reference to the exemplary embodiments and with reference to the accompanying drawings in which.

DETAILED DESCRIPTION OF PREFERRED EMBODIMENTS

Figure 1:
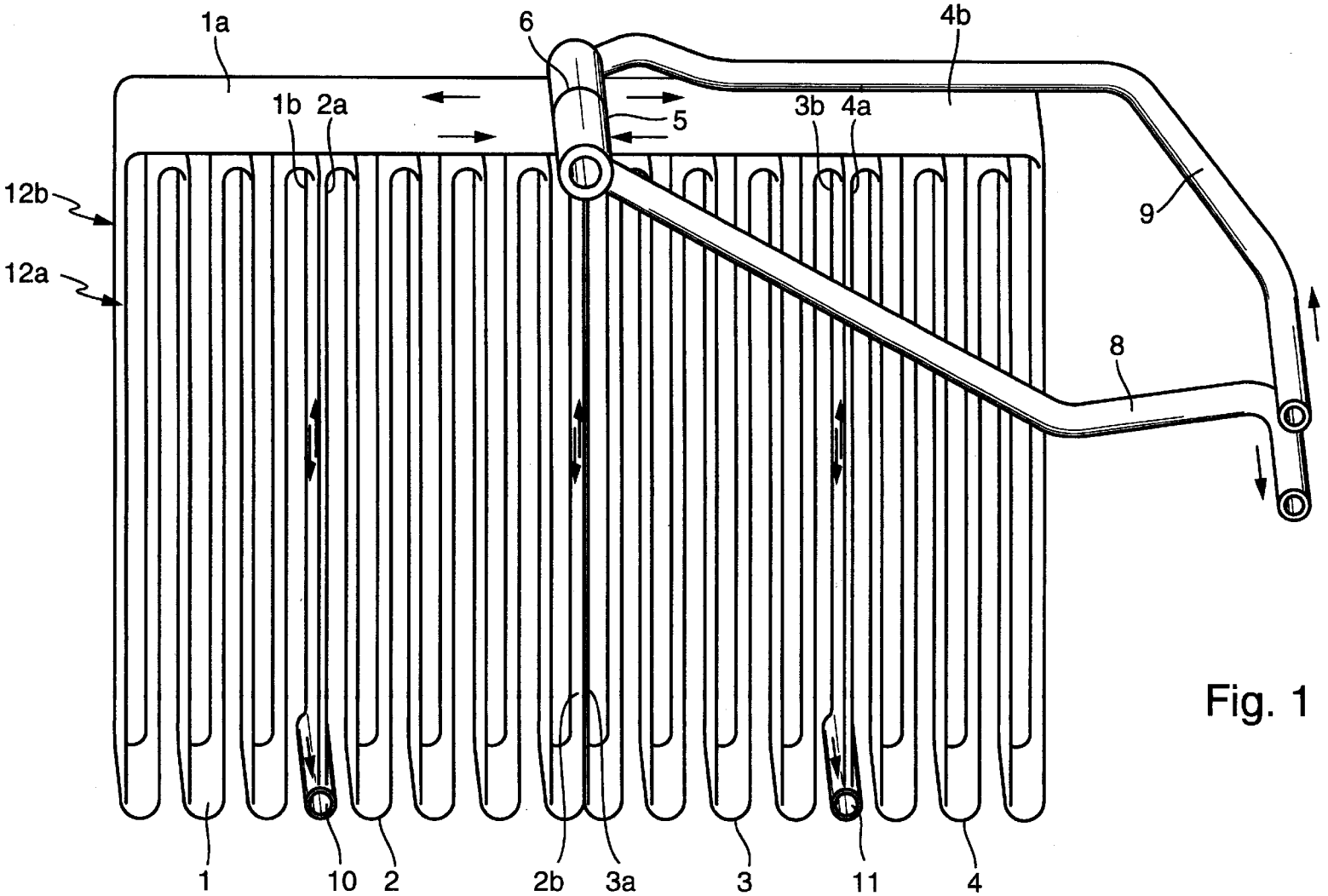
FIG. 1 shows a diagrammatic perspective view of a serpentine heat exchanger consisting of multichannel serpentine flat tubes with a block unit, divided in two for flow purposes, in the depth direction of the block and with a central (laterally) collector tube connection.

The invention comprises a serpentine heat exchanger. In one preferred embodiment of this heat exchanger, at least one of the second serpentine tube sections of a rear tube block is connected in series, for flow purposes, to a first serpentine tube section of a front tube block, positioned adjacent thereto, by a corresponding diversion section. Accordingly, flow occurs in series through the two serpentine tube sections arranged one behind the other. As a result of this flow, a good distribution of heat or temperature can be achieved throughout the entire heat exchanger. At the same time, such a heat exchanger can be produced relatively simply with comparatively few joints, such as brazed joints, and it possesses the necessary stability with respect to high pressure and a relatively small pressure drop.

In another preferred aspect of the invention, two respective serpentine tube sections, arranged one behind the other are connected, for fluid flow purposes, in series in a manner providing through-flow in opposite directions. This further contributes to a homogeneous temperature distribution. A further improvement with regard to homogeneous temperature distribution can be achieved with an embodiment in which a plurality of serpentine tube sections are provided in each of two tube blocks arranged one behind the other. According to this embodiment, each pair of adjacent serpentine tube sections of one tube block, together with the corresponding, opposite two adjacent serpentine tube sections of the other tube block, are connected with one another via a corresponding diversion section. The connection is made in a manner such that the flow passes in opposite directions both through the serpentine tube sections arranged one behind the other, and through respective, adjacent serpentine tube sections.

In a further exemplary embodiment of the invention, a heat exchanger is constructed from multichannel serpentine flat tubes. As a result of appropriate division of the plurality of channels of each flat tube, the flat tubes integrally form the tube blocks lying one behind the other.

In a further preferred serpentine heat exchanger according to the invention, a common collection tube is provided as a connecting structure for all serpentine tube sections. The common collection tube is disposed on a narrow side of the tube block unit which consists of two or more tube blocks arranged one behind the other, with a longitudinal axis lying in the depth direction of the block. The collection tube is subdivided by a transverse partition into two collection chambers, which are arranged one behind the other and into which all the serpentine tube sections of the front and rear tube blocks open by their connecting ends.

A further preferred serpentine heat exchanger according to the present invention exhibits an alternative connection structure. This connection structure contains one collection tube extending along one connection side of the block for each of two tube blocks which are arranged one behind the other. The connection ends of all serpentine tube sections of the tube block concerned open directly or via assigned connection pieces into the collection tube. According to a variation on this heat exchanger, the connection pieces may consist of connection tube pieces extending along the depth direction of the block and being subdivided by a transverse partition into two connection chambers. The connection ends of two adjacent serpentine tube sections of the front and rear tube blocks open into each of the connection chambers.

Figure 2:
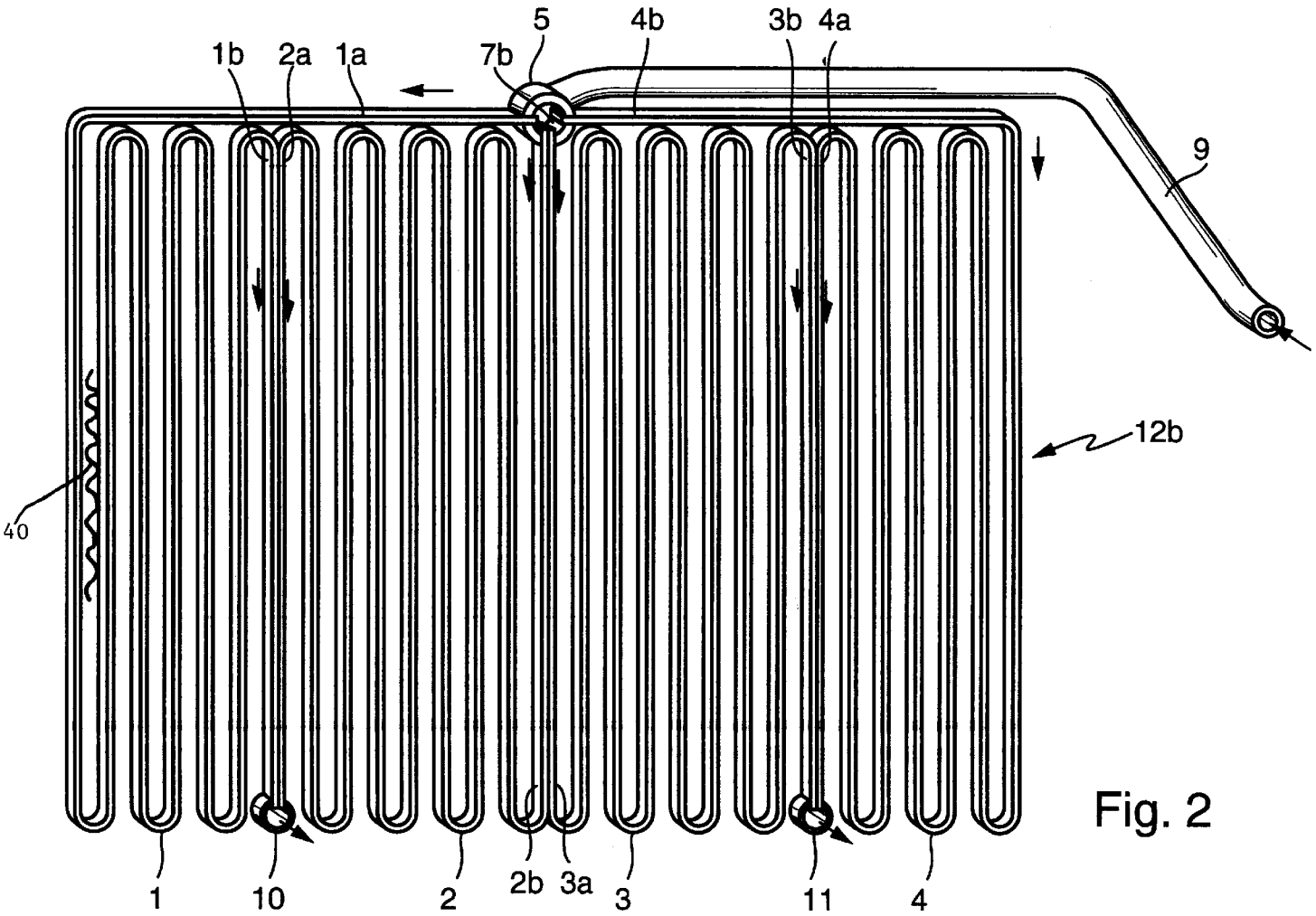
FIG. 2 shows a perspective view of the rear tube block in FIG. 1.
Figure 3:
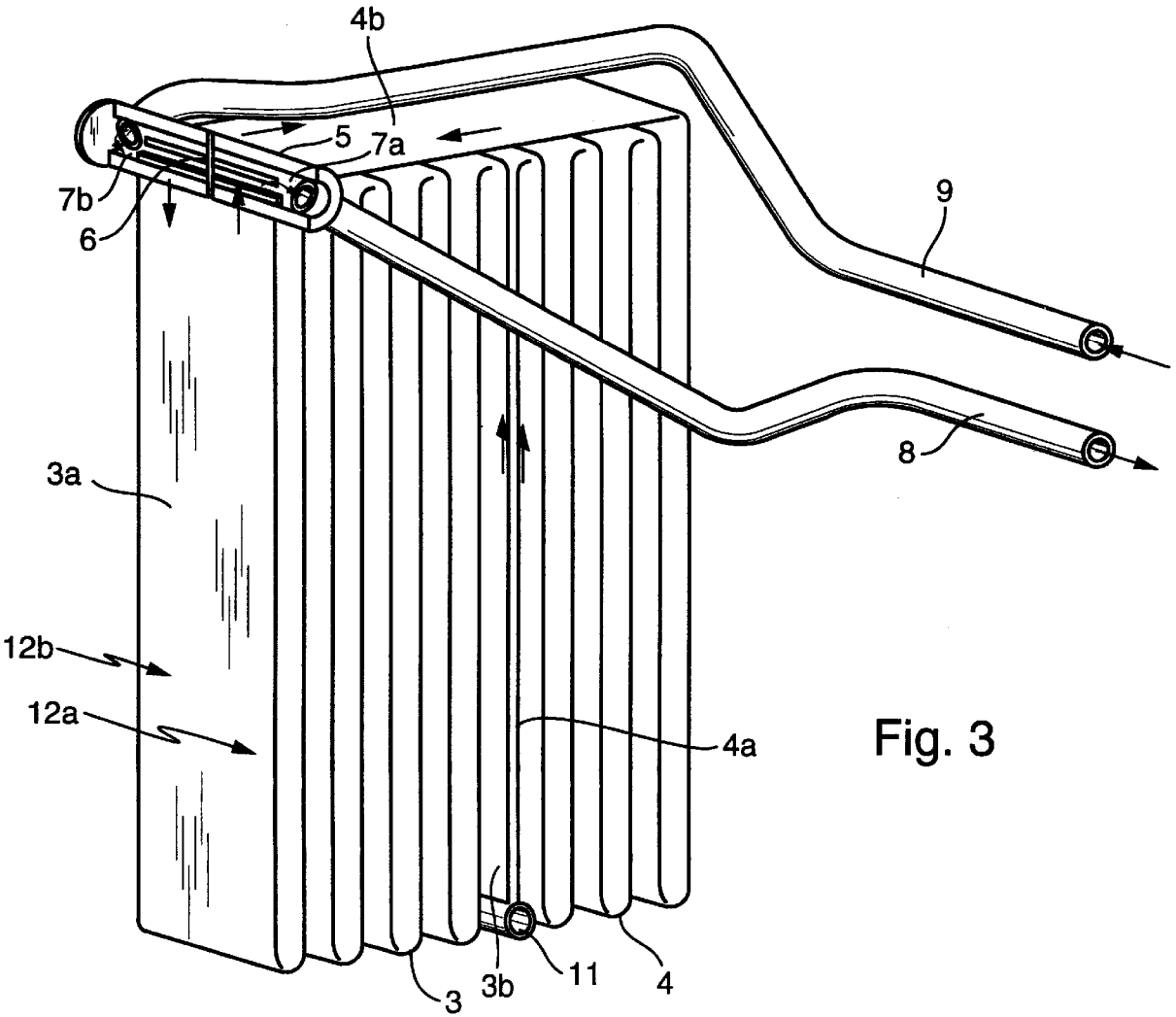
FIG. 3 shows a perspective view of the part of the tube block unit on the right in FIG. 1.

Turning now to the drawings, FIGS. 1, 2 and 3 show a first exemplary serpentine heat exchanger with a tube block unit that comprises four multichannel flat tubes 1, 2, 3, 4 adjacently disposed in a transverse direction of the block. In this arrangement, adjacent pairs of serpentine flat tubes are fixed to one another with physical contact along their mutually facing end sections 1*b*, 2*a* and also 2*b*, 3*a* and 3*b*, 4*a*.

The two inner serpentine flat tubes 2, 3 open with their adjacent, inner end sections 2*b*, 3*a* into a collector tube 5. The collector tube 5 is disposed, for example, at the center of a block side of the tube block unit. The collector tube 5 functions as a connection side with its longitudinal axis disposed in the depth direction of the block and is closed at both end faces. A transverse partition 6, approximately centered in the collector tube 5, subdivides the latter into two collection chambers 7*a*, 7*b*, arranged one behind the other (FIG. 3). One of the chambers serves as the inlet-side distributor chamber and the other as the outlet-side collection chamber. One connection tube 8, 9 for feeding and removing a heat exchange medium to be passed through the serpentine flat tubes 1 to 4 opens into each of two collection chambers 7*a*, 7*b*. The above-referenced medium may be, for example, a refrigerant of a motor vehicle air-conditioning system, for which the heat exchanger can be used as an evaporator or condenser/gas cooler. The outer end sections 1*a*, 4*b* of the two outer serpentine flat tubes 1, 4 may, for example, be curved around at the block connection side, parallel to the latter, as tube connection extension pieces. The outer end sections 1*a*, 4*b* likewise open at their ends into the collector tube 5.

The serpentine flat tube ends introduced peripherally into the collector tube 5 each open with one part of their plurality of channels. The two collection chambers 7*a*, 7*b* are separated by the transverse petition 6, into one or the other of the two collection chambers 7*a*, 7*b*. Although, channels are arranged next to one another along the width of the flat tube with spacing in between, they are not explicitly shown for the sake of clarity. In this arrangement, the flat tube ends to be inserted into the collector tube are provided with a suitable slit between two channels in order to be able to receive the transverse partition 6 therein.

Opposite the block connection side, at the tube block side, the ends of end sections 1*b*, 2*a* and 3*b*, 4*a*, of the respective outer serpentine flat tube 1, 4 and the neighboring inner serpentine flat tube 2, 3 open into a diversion section which is formed by, for example, a diversion pipe piece 10, 11. The diversion pipe piece 10, 11 extends in the depth direction of the block and has a length substantially corresponding to the depth of the tube block. The associated flat tube ends open peripherally into the tube block which is closed at both end faces. End section 1*b*, 2*a* and 3*b*, 4*a* lie against one another. In the arrangement above, the diversion tube pieces 10, 11 simultaneously function as mixing and, if necessary, homogenizing intermediate collectors, by means of which each of two parallel flows is (i) brought together again, (ii) remixed and homogenized, if necessary, (iii) diverted in the depth direction of the block and (iv) divided again into two parallel flows.

An exemplary serpentine flat tube block thus constructed therefore contains, in a structurally integrated assembly, two tube blocks. Specifically, the serpentine flat tube block comprises a front tube block 12*a* and a rear tube block 12*b*, with differentiable fluid flow patterns. The front tube block 12*a* comprises that front part of the serpentine flat tubes 1 to 4 whose flat tube channels open into a front collection chamber 7*a*. The rear tube block 12*b* comprises the remaining, rear part of the serpentine flat tubes 1 to 4 that contains the remaining channels of each serpentine flat tube 1 to 4, which open into the rear collection chamber 7*b*. In the front and rear tube blocks 12*a,* 12*b,* the corresponding front and rear serpentine flat tube halves are connected in a manner providing for parallel flow therethrough. The flow passes in opposite directions through corresponding adjacent serpentine flat tubes. In other words, considering two neighboring serpentine flat tubes in FIG. 1, the flow passes through one from left to right and through the other from right to left. The diversion tube pieces 10, 11 serve to divert the flow along the depth direction of the block. In other words, the front and the rear tube block 12*a,* 12*b* are, for flow purposes, connected in series via the two deflection tube pieces 10, 11.

The resulting through-flow characteristic for the medium to be passed through the serpentine flat tubes 1 to 4 is indicated diagrammatically in FIGS. 1 to 3 with reference to flow arrows for whichever of the two possible directions of through-flow is used to feed the medium via the connection tube 9. In the exemplary embodiment depicted here, the connection tube 9 functions as a feed tube, into the rear collection chamber 7*b.* After flowing through both tube blocks 12*a,* 12*b,* the medium is then removed from the front collection chamber 7*a* via the connection tube 8 which functions here as an outflow tube. As indicated by the flow arrows, the medium fed into the rear collection chamber 7*b* is distributed from there over the parallel flow channels of the rear tube block 12*b.*

More precisely, in this exemplary embodiment, the medium flows first into the rear channel or channels of the two adjacent inner end sections 2*b,* 3*a* of the two inner serpentine flat tubes 2, 3 and, within the latter, flows outwardly in a serpentine manner to the diversion tube pieces 10, 11. The medium also flows into the rear channels of the connection extensions 1*a,* 4*b* of the two outer serpentine flat tubes 1, 4, in order to flow from there along the block connection side. The medium subsequently flows inwardly, in a serpentine manner, back to the diversion tube pieces 10, 11. This results in the above-mentioned opposite direction of serpentine flow through respective neighboring rear serpentine flat tube sections. The medium then passes into the front tube block 12*a,* via the diversion tube pieces 10, 11, i.e., more specifically, first into the front channels of the associated adjacent flat tube end sections 1*b,* 2*a* and 3*b,* 4*a,* respectively, which open into the front tube block 12*a.* The medium flows from there outwardly in a serpentine manner in the outer serpentine flat tubes 1, 4 and inwardly in the inner serpentine flat tubes 2, 3. The four parallel streams of the front tube block 12*a* are then combined in the front collection chamber 7*a.*

This results in a serpentine through-flow in opposite directions, both (i) for the flow channels of neighboring serpentine flat tubes within each of the front and rear tube blocks 12*a,* 12*b* and (ii) of the flow channels, arranged one behind the other in the depth direction of the block, of the front tube block 12*a* and of the rear tube block 12*b* for each of the serpentine flat tubes 1 to 4. When the complete heat exchanger tube block is used for heating or cooling purposes with a corresponding heating medium or coolant flowing through it, this permits a very homogeneous temperature distribution for a medium which is to be heated or cooled. The medium to be heated or cooled, for example, an air stream serving to air-condition a motor vehicle passenger compartment, is conducted away in the depth direction of the block at the outside of the serpentine flat tubes 1 to 4 after passing through the heat exchanger tube block. A uniform temperature distribution over the heat exchanger tube block results in a correspondingly homogeneous temperature control of the medium whose temperature is to be controlled. The uniform temperature distribution also improves any planned temperature adjustment via a temperature sensor disposed on the heat exchanger block, since this arrangement avoids the possibility that the sensor may be positioned at a point where the temperature differs sharply from the temperature mean value and thereby influences the adjustment unfavorably. In evaporator applications, such as, for example, an air-conditioning system in a motor vehicle, the relatively uniform temperature distribution prevents unfavorable influences on the adjustability of the air conditioning system. In an air-conditioning system in a motor vehicle, for example, individual flat tube channels are prevented from being overfilled and other channels from being underfilled and drying out as the driving status of the vehicle changes.

As a further advantage, the heat exchanger tube block unit of the invention can be produced with the use of corresponding pressure-resistant serpentine flat tubes with the desired stability to pressure. Assembly of the tube block requires only relatively few brazed joints. Moreover, this serpentine heat exchanger can be produced with a relatively low pressure drop for the medium passed through the serpentine flat tubes 1 to 4. In addition to use as an evaporator, the serpentine heat exchanger can also serve as a condenser/gas cooler in air-conditioning systems, for example, in air-conditioning systems for motor vehicles.

Figure 4:
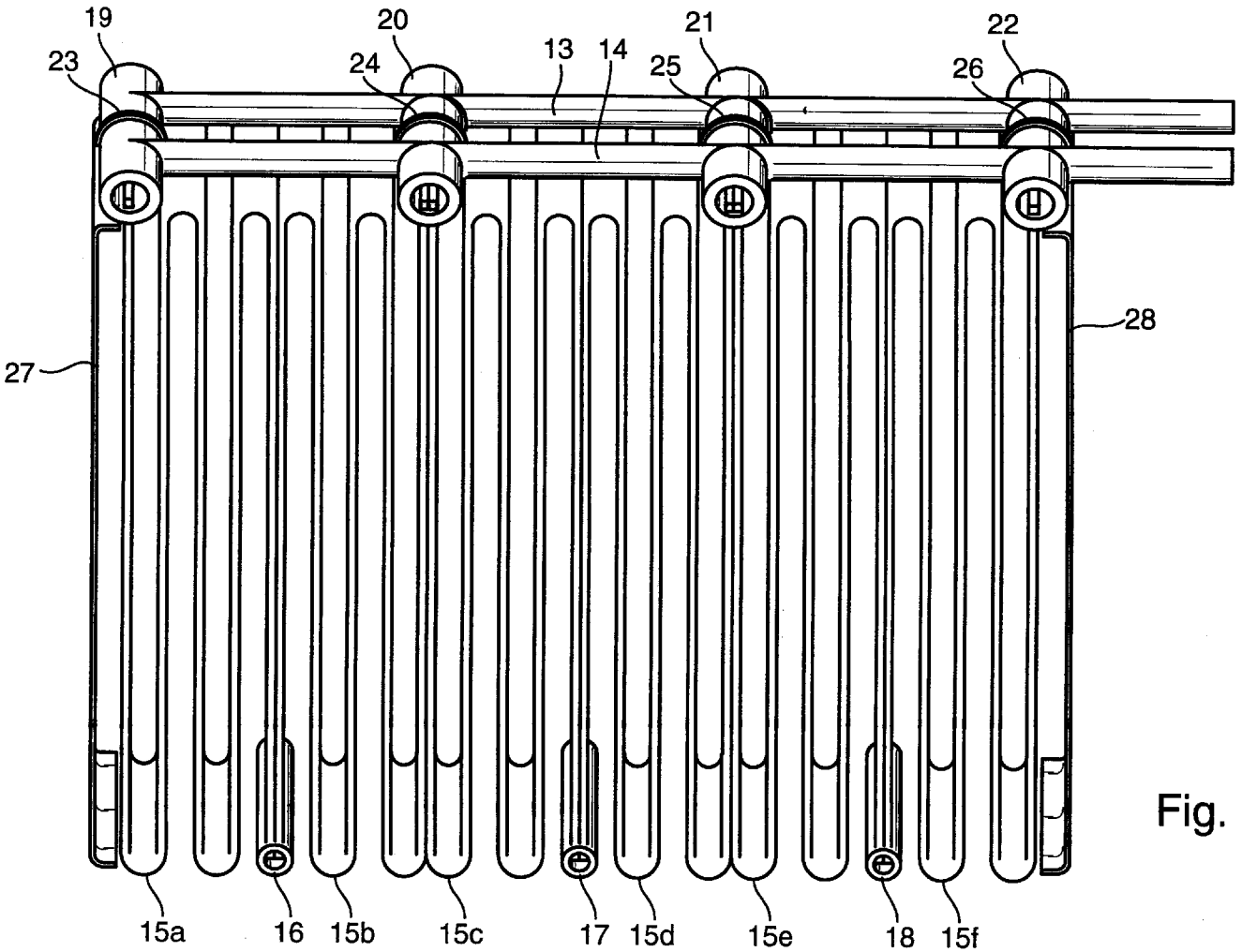
FIG. 4 shows a perspective view of a serpentine heat exchanger consisting of multichannel serpentine flat tubes with a tube block unit divided in two in the depth direction of the block, and with a lateral connection structure having a plurality of connector tube pieces.
Figure 5:
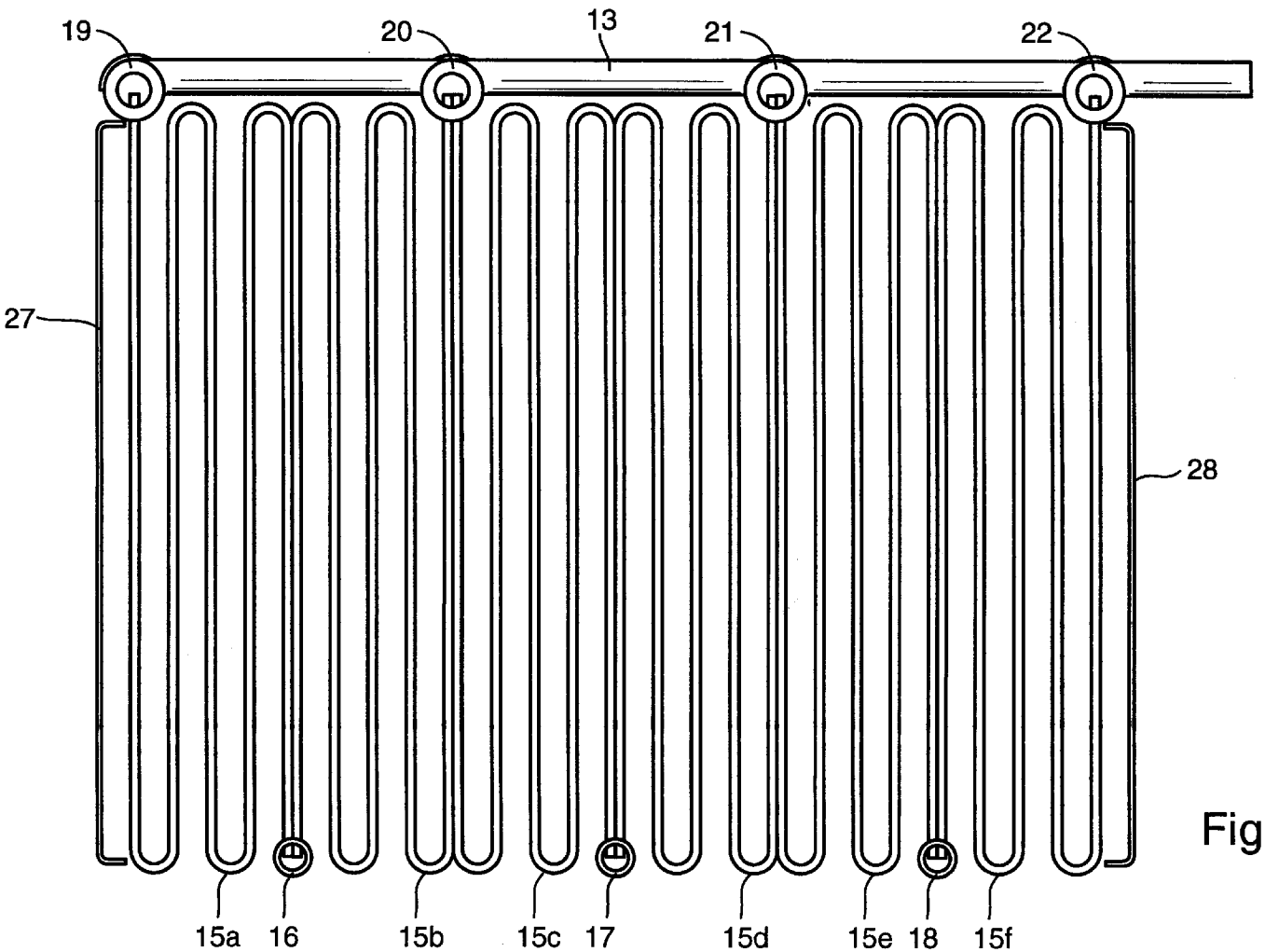
FIG. 5 shows a plan view of the rear tube block in FIG. 4.

As a further exemplary embodiment according to the invention, FIGS. 4 and 5 show a serpentine heat exchanger having a design principle which corresponds substantially to that of the exemplary embodiment shown in FIGS. 1 to 3. An essential difference between the exemplary embodiment of FIGS. 4 and 5 and that of FIGS. 1 to 3 is that the heat exchanger of FIGS. 4 and 5 possesses a non-centrally located connection structure, which comprises a rear connection tube or collector tube 13 for a rear tube block and a front connection tube or collector tube 14 for a front tube block. In this arrangement, the front and rear tube blocks are formed, in turn, as integral parts of a complete tube block comprising a plurality of adjacent multichannel serpentine flat tubes 15*a* to 15*f.*

In this example, the division of the complete tube block into the front and rear tube blocks is provided by four identical connection tube pieces 19 to 22, which, in the same way as the connection tube piece 5, shown in the exemplary embodiment of FIGS. 1 to 3, are each disposed with their longitudinal axes pointing in the depth direction of the block. The longitudinal tube pieces 19–22 are likewise each subdivided by a transverse partition 23 to 26 into a front collection chamber, which is in connection with the front collector tube 14, and a rear collection chamber, which is in connection with the rear collector tube 13, and the tube pieces 19–22 are closed at the two end faces.

The mutually facing end sections of each pair of adjacent serpentine flat tubes are in turn fixed to one another and open, at the block connection side, into the associated connection pipe piece 20, 21 or on the opposite side into one of three diversion tube pieces 16, 17, 18. The three diversion tube pieces 16, 17, 18 each serve as an element to provide in-series connection between the front and rear tube blocks. The two outer serpentine flat tubes 15*a,* 15*f* end with their outer end sections without extension on the connection side into the two outer connection tube pieces 19, 22. Two side plates 27, 28 serve as lateral terminations of the serpentine tube block.

The through-flow characteristic of the heat exchanger shown in FIGS. 4 and 5 corresponds to that of the heat exchanger shown in FIGS. 1 to 3. In other words, depending on the form of connection, the medium to be passed through is fed through the front or rear collector tube as an inlet tube, parallel to the collection chambers connected thereto of the front and rear tube blocks, respectively. From there the medium is distributed over the front and rear flat tube channels, respectively, which leave in parallel. The medium then flows first into respective neighboring serpentine flat tubes of the inlet-side tube block in opposite directions to the diversion tube pieces 16, 17, 18. The medium is then diverted into the other, outlet-side front and rear tube blocks, respectively. There, the medium again flows through the outlet-side tube block in opposite directions, both with respect to neighboring serpentine flat tubes and with respect to channels lying one behind the other. Via the outlet-side collection chambers and the associated collector pipe, as an outlet pipe, the medium is then removed again from the serpentine tube block. Because of the identical flow characteristic, the serpentine heat exchanger shown in FIGS. 4 and 5 also has the same properties and advantages as were indicated above in connection with the heat exchanger shown in FIGS. 1 to 3, to which reference may be made.

Because of the uniform temperature distribution produced thereby, the heat exchangers of the invention also allow reversed installation and may, for example, be used as evaporators in motor vehicle air-conditioning systems. In other words, they may be installed with the block connection side on the bottom, so that the coolant supplied initially flows from bottom to top. This makes it possible for the heat exchanger, when functioning as an evaporator in a normal mode of operation, to automatically and desirably provide, in a different mode of operation wherein it functions as a heating member, a higher-temperature air flow for a foot-space region, and a lower-temperature air flow for a head-space region, of a passenger compartment which is to be air-conditioned.

It will be understood that the heat exchangers shown may, as required, contain further components not illustrated in detail here, such as, for example, undulating fins 40 in the intervening spaces between the linear serpentine tube sections to improve strength and heat transmission capability. As an alternative to the contact joining of the mutually facing end sections 1*b*, 2*a*; 2*b*, 3*a*; 3*b*, 4*a* which is shown, such an undulating fin may also be provided between each of the latter. In other words, in this case, the tube end sections are fixed at a distance from one another to the intervening undulating fin. The undulating fin expediently ends at some distance in front of the associated collector tube or diversion tube piece into which the two associated tube end sections open, e.g., as shown in DE 197 29 497, the entire disclosure of which is incorporated by reference herein. The two tube ends projecting above the undulating fins are then preferably brought together and, as in the case shown where tube end sections are adjacent and in physical contact over their entire length, inserted into the appropriate collector tube or diversion tube piece with physical contact. It will also be understood that the invention comprises further advantageous embodiments of serpentine heat exchangers including, for example, heat exchangers with three or more tube blocks arranged one behind the other in the depth direction of the block, or heat exchangers with tube blocks that are assembled separately from their own respective serpentine flat tubes rather than produced integrally and that are connected to one another in serial fluid communication via diversion tube pieces of the type shown or of any other desired diversion sections that perform the desired diversion function.

The right of priority is claimed based on German Patent Application No. 100 49 256.8, filed Oct. 5, 2000, the disclosure of which is hereby incorporated by reference in its entirety.

The foregoing embodiments have been shown for illustrative purposes only and are not intended to limit the scope of the invention which is defined by the claims.

What is claimed is:

1. A heat exchanger comprising:

(a) a first serpentine tube block comprising at least one serpentine tube section;

(b) a second serpentine tube block comprising at least one serpentine tube section;

(c) a diversion section; wherein said second serpentine tube block is arranged behind said first serpentine tube block and wherein at least one serpentine tube section of said second serpentine tube block is in serial fluid communication with at least one serpentine tube section of said first serpentine tube block via said diversion section; and (d) a single collecting tube for the heat exchanger provided at a connection side of said heat exchanger with a longitudinal axis lying in a depth direction of the block wherein said collecting tube further comprises a transverse partition which subdivides said collecting tube into two collecting chambers arranged one behind the other in said depth direction.

2. The heat exchanger according to claim 1, wherein said first serpentine tube block comprises a plurality of serpentine tube sections.

3. The heat exchanger according to claim 2, wherein said plurality of serpentine tube sections is arranged so as to allow parallel flow therethrough.

4. The heat exchanger according to claim 1, wherein said second serpentine tube block comprises a plurality of serpentine tube sections.

5. The heat exchanger according to claim 4, wherein said plurality of serpentine tube sections are arranged so as to allow parallel fluid flow therethrough.

6. The heat exchanger according to claim 1, wherein at least one serpentine tube section of said second serpentine tube block is connected in serial fluid communication to a corresponding serpentine tube section of said first serpentine tube block via said diversion section in a manner allowing for fluid flow through said at least one serpentine tube section of said second serpentine tube block in an opposite direction as compared to fluid flow though said at least one serpentine tube section of said first serpentine tube block.

7. The heat exchanger according to claim 1, further comprising a plurality of adjacent serpentine tube sections provided within each of said first and second serpentine tube blocks and two adjacent serpentine tube sections of said first serpentine tube block with through-flow in opposite directions and two adjacent serpentine tube sections of said second serpentine tube block with through-flow in opposite directions open into the respective diversion section.

8. The heat exchanger according to claim 1, wherein tubes in said first and second tube blocks comprise a plurality of adjacent multichannel flat serpentine tubes which form said first and said second serpentine tube blocks by division of said plurality of channels of each flat serpentine tube, to form in each tube at least one first sub-channel in said first tube block and at least one second sub-channel in said second tube block.

9. The heat exchanger according to claim 8, wherein flow in each of said first sub-channels is opposite to flow in its adjacent second sub-channel.

10. The heat exchanger according to claim 1, further comprising two collecting tubes which extend along a block connection side of said heat exchanger and which are provided for each of said first and second serpentine tube blocks.

11. The heat exchanger according to claim 1, further comprising a plurality of connector tube pieces having longitudinal axes that lie in a depth direction of the block and wherein said connector tube pieces are arranged at intervals along a block connection side.

12. The heat exchanger according to claim 11, wherein each of said connector tube pieces further comprises a transverse partition which subdivides each connector tube piece into two collection chambers, one arranged behind the other in said depth direction.

13. The heat exchanger according to claim 12, wherein each of said connector tube pieces is connected to one of two collection pipes.

14. An air-conditioning system comprising a heat exchanger which comprises:

(a) a first serpentine tube block comprising at least one serpentine tube section;

(b) a second serpentine tube block comprising at least one serpentine tube section;

(c) a diversion section; wherein said second serpentine tube block is arranged behind said first serpentine tube block and wherein at least one serpentine tube section of said second serpentine tube block is in serial fluid communication with at least one serpentine tube section of said first serpentine tube block via said diversion section; and (d) a single collecting tube for the heat exchanger provided at a connection side of said heat exchanger with a longitudinal axis lying in a depth direction of the block wherein said collecting tube further comprises a transverse partition which subdivides said collecting tube into two collecting chambers arranged one behind the other in said depth direction.

15. A motor vehicle including an air-conditioning system, wherein said air-conditioning system comprises a heat exchanger which comprises:

(a) a first serpentine tube block comprising at least one serpentine tube section;

(b) a second serpentine tube block comprising at least one serpentine tube section;

(c) a diversion section; wherein said second serpentine tube block is arranged behind said first serpentine tube block and wherein at least one serpentine tube section of said second serpentine tube block is in serial fluid communication with at least one serpentine tube section of said first serpentine tube block via said diversion section; and (d) a single collecting tube for the heat exchanger provided at a connection side of said heat exchanger with a longitudinal axis lying in a depth direction of the block wherein said collecting tube further comprises a transverse partition which subdivides said collecting tube into two collecting chambers arranged one behind the other in said depth direction.

16. A heat exchanger comprising:

(a) a front tube block;

(b) a rear tube block arranged in serial fluid communication with said front tube block;

(c) a collector tube;

(d) a partition plate arranged to divide said collector tube into a front collection chamber and a rear collection chamber;

(e) a front flat tube channel in fluid communication with said front collection chamber;

(f) a rear flat tube channel in fluid communication with said rear chamber and arranged to allow for parallel flow along with said front flat tube channel;

(g) front serpentine flat tubes in fluid communication with said front flat tube channel;

(h) rear serpentine flat tubes in fluid communication with said rear flat tube channel;

(i) a front diversion tube piece in fluid communication with said front serpentine flat tubes;

(j) a rear diversion tube piece in fluid communication with said rear serpentine flat tubes;

(k) an outlet side front tube block in fluid communication with said front diversion tube piece;

(l) an outlet side rear tube block in fluid communication with said rear diversion tube piece such that a medium may flow in an opposite direction to a medium flowing through said outlet side front tube block;

(m) a first outlet side collection chamber in fluid communication with said outlet side front tube block;

(n) a second outlet side collection chamber in fluid communication with said outlet side rear tube block; and (o) a collector pipe in fluid communication with said first and second outlet side collection chambers.

* * * * *